United States Patent [19]

Leo

[11] Patent Number: 4,794,578

[45] Date of Patent: Dec. 27, 1988

[54] NOVELTY WATCH CONSTRUCTION

[76] Inventor: Stephen Leo, 89 N. Broadway, White Plains, N.Y. 10603

[21] Appl. No.: 33,538

[22] Filed: Apr. 3, 1987

[51] Int. Cl.[4] ..... G04B 37/00; A44C 5/00

[52] U.S. Cl. ..... 368/316; 368/282; 224/164; 248/116; 248/175

[58] Field of Search ..... 368/276, 278, 281, 282, 368/316–317; 248/153, 175; 63/3, 11, 21; 224/152, 158, 174; 116/114–116; D10/23, 26, 32

[56] References Cited

U.S. PATENT DOCUMENTS

| | | | |
|---|---|---|---|
| 3,085,776 | 4/1963 | Mycock et al. | 248/153 |
| 4,331,721 | 5/1982 | Ayers | 248/175 |

FOREIGN PATENT DOCUMENTS

| | | | |
|---|---|---|---|
| 60-162979 | 8/1985 | Japan | 368/276 |
| 60-165574 | 8/1985 | Japan | 368/276 |
| 256588 | 8/1948 | Switzerland | 368/316 |
| 323379 | 7/1957 | Switzerland | 368/316 |
| 113745 | 3/1918 | United Kingdom | 368/316 |

*Primary Examiner*—Vit W. Miska

*Attorney, Agent, or Firm*—Charles E. Temko

[57] ABSTRACT

A novelty watch construction which may be selectively used as a wrist watch, a bracelet, a jewelry ornament, or placed upon a horizontal surface to be used as a desk clock or the like. The novel construction employs a casing element adapted to either house the watch movement directly, or engage an existing watch case. The housing is provided with a threaded or contoured socket. In lieu of a watch strap, there is provided an elongated member having a flexible metal core capable of retaining an imparted shape, the casing being enclosed in a flexible cover of synthetic or natural rubber-like material. One end of the flexible member is provided with means engaging the socket in the housing.

4 Claims, 1 Drawing Sheet

NOVELTY WATCH CONSTRUCTION

BACKGROUND OF THE INVENTION

This invention relates generally to the field of novelty jewelry, and more particularly to an improved novelty watch construction having utility as a decorative article which may be used as a piece of jewelry, a bracelet, or used as a desk clock.

It is known in the art to provide small watch movements with various forms of means so that they may be supported on a horizontal surface.

More recently, there has been a decorative trend to design various objects d'art incorporating a timepiece, some suitable for wearing on the person of the user. Typical are pendants, brooches, and the like. Such devices, while not without utility, lack flexibility of use in that they are adapted to be used only in a single mode of adornment of the wearer, and after a relatively limited period of time, the resulting distinctive appeal substantially diminishes.

SUMMARY OF THE INVENTION

Briefly stated, the invention contemplates the provision of an improved watch construction capable of multiple forms of installation to create a variety of pleasing ornamental effects. More particularly, the disclosed embodiments include means for retaining a watch movement in a decorative casing or housing, either directly, or by engaging an existing watch case which encloses the movement. In either case, the means includes a threaded or bayonet type socket on an outer surface thereof. Selectively engaging the socket is an elongated wire-like element, including a core capable of retaining an imparted shape, and covered with a suitable decorative covering of natural or synthetic rubber-like material. One end of the wire-like element is provided with means for engaging the socket. To use the device, it is only necessary to bend the wire-like element to desired configuration, depending upon contemplated use. In one mode of use, the element may be supported about the arm or wrist of the wearer. In another mode of use, the wire-like element may be bent to form a base for supporting the housing in conveniently viewable position upon a horizontal surface such as a desk or table. In still another mode of use, the wire-like element may be bent to the shape of a hook to support the watch in pendant fashion.

BRIEF DESCRIPTION OF THE DRAWINGS

In the drawing, to which reference will be made in the specification, similar reference characters have been employed to designate corresponding parts throughout the several views.

DETAILED DESCRIPTION OF THE DISCLOSED EMBODIMENTS

Figure 1:
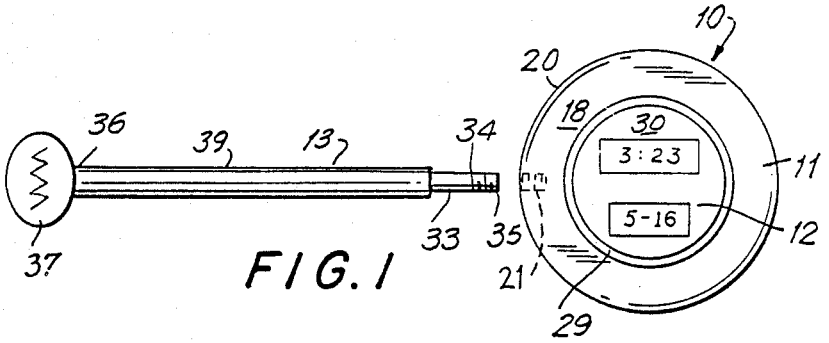
FIG. 1 is an exploded view of an embodiment of the invention.

In accordance with the first embodiment of the invention, the device, generally indicated by reference character 10, comprises broadly, a watch housing 11, a conventional watch movement 12 housed therein, and a wire-like strap element 13.

The housing 11 is preferably molded from synthetic resinous materials possessed of a degree of resiliency, and is bounded by outer side surfaces, one of which is indicated by reference character 18, and a curved peripheral surface 20. A threaded socket 21 extends inwardly of the surface 20. A larger through opening accommodates an existing watch housing in which the movement 12 is disposed.

The watch movement 12 is conventional, and may be either of mechanical or electronic type, most conveniently, the latter. It will normally be positioned within a separate housing or bezel 29, to present an exposed face 30 readily viewable to the user.

The wire-like strap element 13 includes a length of relatively thick material, such as aluminum wire 33 capable of retaining a manually imparted shape. A first end 34 thereof is provided with a threaded terminal 35 which selectively engages the socket 21. A second end 36 may be provided with a decorative enlargement 37, formed integrally therewith, or attached in any suitable manner. Surrounding the wire 33 which forms a core is a decorative covering 39 of natural or synthetic resinous rubber-like material.

Figure 2:
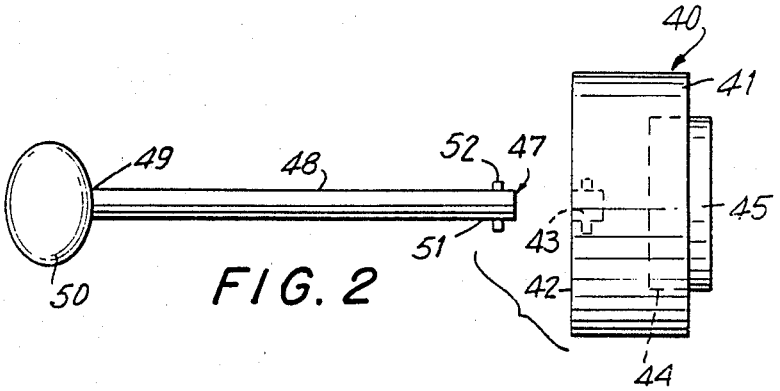
FIG. 2 is a similar view showing an alternate form of the embodiment.

FIG. 2 illustrates an alternate or second embodiment of the invention, generally indicated by reference character 40. A housing 41 includes a rear surface 42 provided with a bayonet-type socket 43. A separate recess 44 accommodates a watch movement 45. The wire-like strap element 47, as in the first embodiment, includes an elongated wire-like member 48, the outer end 49 of which is provided with an enlargement 50. The inner end 51 is provided with bayonet lugs 52 selectively engageable with the socket 43 in known manner.

Figure 3:
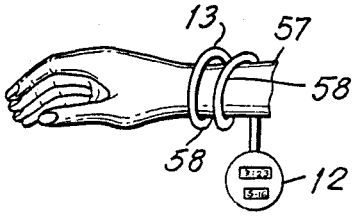
FIG. 3 is a perspective view showing one form of installation of the embodiment.

FIG. 3 illustrates one mode of wearing the first embodiment upon an arm 57 of a wearer. The element 13 is manually wound about the arm, using the fingers of an opposite hand to form convolutions 58, in such manner that the watch movement 12 is disposed in pendent relation to be readily viewed by the user.

Figure 4:
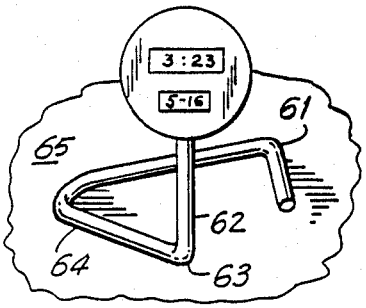
FIG. 4 is a view in perspective showing a second form of installation thereof.

FIG. 4 illustrates another mode of use, in which the wire-like element 61 has been manually bent to include a rectilinear segment 62, a right angle bent portion 63, and a curvilinear portion 64, an under surface of which is adapted to rest upon a horizontal surface 65.

Figure 5:
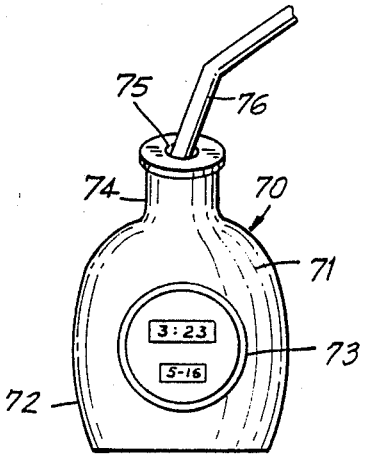
FIG. 5 is a view in elevation showing a third form of the embodiment.

FIG. 5 illustrates a third embodiment of the invention, generally indicated by reference character 70. In this embodiment, the housing 71 is in the form of a bottle, which includes a main body 72 having a central opening 73 to support the watch movement, as well as a neck portion 74 having an opening 75 into which one end of the wire-like element 76 is inserted and engaged. This embodiment may be used in a manner shown in FIG. 3, and where the wire-like element is sufficiently elongated, it may be used in the manner shown in FIG. 4, as well.

It will be apparent to those skilled in the art, that many other embodiments within the spirit of the invention are possible. If desired, the housing and strap element may be molded integrally from a suitable synthetic resin which is capable of retaining an imparted shape.

I wish it to be understood that I do not consider the invention to be limited to the precise details of structure as shown and set forth in this specification, for obvious modifications will occur to those skilled in the art to which the invention pertains.

I claim:

1. A novelty watch construction comprising: a housing having means for engaging a watch movement, said housing having an outer surface, there being an engageable socket extending inwardly of said outer surface; an elongated flexible wire-like element having a core of deformable material capable of retaining an imparted shape, said wire-like element having a first end thereof having means thereon selectively engaging said socket, whereby upon the bending of said wire-like element to predetermined shape, said construction may be engaged with another object to be supported thereby.

2. A watch construction in accordance with claim 1, further characterized in said core of said wire-like element being encased within a decorative sleeve.

3. A watch construction in accordance with claim 1, further characterized in said socket being internally threaded, one end of said wire-like element having corresponding threads thereon for engagement therewith.

4. A watch construction in accordance with claim 1, further characterized in said socket including bayonet type engagement means, one end of said wire-like element having corresponding means for engaging said socket.

* * * * *